US006065541A

United States Patent [19]

Allen

[11] Patent Number: 6,065,541

[45] Date of Patent: May 23, 2000

[54] CLEANING DEVICE

[75] Inventor: Anthony Allen, Aberdeen, United Kingdom

[73] Assignee: EZI-Flow International Limited, London, United Kingdom

[21] Appl. No.: 09/039,191

[22] Filed: Mar. 13, 1998

[30] Foreign Application Priority Data

| | | | |
|---|---|---|---|
| Mar. 14, 1997 | [GB] | United Kingdom | 9705300 |
| Jul. 14, 1997 | [GB] | United Kingdom | 9714604 |
| Aug. 21, 1997 | [GB] | United Kingdom | 9717767 |

[51] Int. Cl.[7] ..... E21B 21/00

[52] U.S. Cl. ..... 166/318; 166/317; 166/320; 166/312; 166/222; 166/223

[58] Field of Search ..... 166/312, 317, 166/318, 320, 222, 223

[56] References Cited

U.S. PATENT DOCUMENTS

| | | | |
|---|---|---|---|
| 3,850,241 | 11/1974 | Hutchinson . | |
| 3,912,173 | 10/1975 | Robichaux . | |
| 4,031,957 | 6/1977 | Sanford | 166/264 |
| 4,176,717 | 12/1979 | Hix | 166/289 |
| 4,279,306 | 7/1981 | Weitz . | |
| 4,393,930 | 7/1983 | Ross et al. . | |
| 4,529,038 | 7/1985 | Brieger . | |
| 4,781,250 | 11/1988 | McCormick et al. . | |
| 4,899,821 | 2/1990 | Casida . | |
| 4,919,204 | 4/1990 | Baker et al. . | |
| 5,337,819 | 8/1994 | Tailby | 166/222 |
| 5,474,130 | 12/1995 | Davis . | |
| 5,533,571 | 7/1996 | Surjaatmadja et al. . | |
| 5,564,500 | 10/1996 | Rogers et al. . | |

FOREIGN PATENT DOCUMENTS 9804816 8/1998 United Kingdom .

*Primary Examiner*—David Bagnell
*Assistant Examiner*—Chi H. Kang
*Attorney, Agent, or Firm*—Jenkens & Gilchrist

[57] ABSTRACT

A cleaning device for a well bore which is adapted to be connected to a drill string for insertion into the well bore and through which cleaning fluid is pumped, comprises an elongated outer sleeve having an axially extending through bore therein and at least one port in the side wall of the outer sleeve, each of which ports is axially spaced along the outer sleeve. An elongated inner sleeve having, an axially extending through bore therein is coaxial with and axially slidable within the outer sleeve. An annular seating collar is located within the through bore in the inner sleeve and at least one port is provided in the side of the inner sleeve. The ports are axially spaced along the inner sleeve. Pressure sensitive stops means serve to retain the inner sleeve in place within the outer sleeve at each of a plurality of predetermined axially spaced positions in turn. Means for obstructing the annular seating collar and each of the ports in the inner sleeve are dropped into the cleaning device one at a time such that, when cleaning fluid is first connected to the cleaning device it passes through the inner sleeve and with that insertion of the first and each subsequent obstructing means the inner sleeve is caused to move axially downwards relative to the inner sleeve onto each pressure sensitive stop means in turn and in each of these positions a port in the inner sleeve is radially aligned with a port in the outer sleeve.

67 Claims, 13 Drawing Sheets

CLEANING DEVICE

This application claims priority from U.K. Patent Application No. GB-9705300.3 filed on Mar. 14, 1997; U.K. Patent Application No. GB-9714604.7 filed Jul. 14, 1997; and U.K. Patent Application No. GB-9717767.9 filed Aug. 21, 1997.

TECHNICAL FIELD

The present invention relates to a device for cleaning the walls and particularly the casing or liner of the well bore of an oil or natural gas well.

BACKGROUND

Over a period of use, the casing or liner within the well bore of an oil or natural gas well becomes covered with hard deposits. These deposits must be periodically removed or they can build up to levels of thickness and hardness where they can adversely effect efficient operation of the oil well.

Cleaning involves spraying or jetting the inner wall of the casing with cleaning fluid at very high pressure to break up and dislodge the deposited material. This is achieved by means of a cleaning device with jetting nozzles in the sides of it which is lowered down into the well bore casing on the end of a drill string. Once a section of the well bore casing has been jet cleaned, the cleaning device is withdrawn from the well bore casing and removed from the end of the drill string. The drill string is then returned to the well bore casing where cleaning fluid is run down through it to a point below the section of the well bore casing which has been jet cleaned. The cleaning fluid rises up inside the space between the well bore casing and the drill string and as it does so, it carries material broken up and dislodged during the jetting operation to the top of the well bore casing. In this way the well bore casing is flushed clean. This operation is repeated as many times as is necessary to clean the well bore casing of deposited material from top to bottom.

While the method of cleaning described above is effective, it is also very time consuming in that the cleaning device must be repeatedly inserted into the well bore casing to allow for jet cleaning and then withdrawn to allow the material cleaned away from the wall of the well bore casing to be flushed out. During a cleaning operation the well is, of course, not producing oil or natural gas. This downtime is costly and therefore undesirable.

The problems arising from material building up within a well bore are not, of course, restricted to the riser liner of the well bore. Material may also build up below this which it is preferable to dislodge and remove from the well bore.

SUMMARY

The details of one or more embodiments of the invention are set forth in the accompanying drawings and the description below. Other features, objects, and advantages of the invention will be apparent from the description and drawings and from the claims.

A cleaning device for a well bore has been invented which is adapted to be connected to a drill string for insertion into the well bore and through which cleaning fluid is pumped, comprising: an elongated outer sleeve having an axially extending through bore therein; means for connecting one end of the outer sleeve to the drill string; at least one port in the side wall of the outer sleeve, wherein each port is circumferentially spaced along the outer sleeve; an elongated inner sleeve having an axially extending through bore therein and which is co-axial with and axially slidable within the outer sleeve; an annular seating collar located within the through bore in the inner sleeve; at least one port in the side of the inner sleeve, wherein each port is circumferential spaced along the inner sleeve and wherein the ports in the inner sleeve correspond in number and circumferential spacing with the ports in the outer sleeve; pressure sensitive stop means for retaining the inner sleeve in place within the outer sleeve at predetermined axially spaced positions; and means for obstructing the annular seating collar and each port in the inner sleeve in a predetermined sequence such that when cleaning fluid is first connected to the cleaning device, it passes through the inner sleeve and with the insertion of the first and each subsequent obstructing means, the inner sleeve is caused to move axially downwards relative to the inner sleeve onto each pressure sensitive stop means in turn and in each of these positions one port in the inner sleeve is radially aligned with one port in the outer sleeve.

The cleaning device further comprises at least one circumferentially extending slot is provided in the outer surface of the inner sleeve, each of which is connected to the through bore in the inner sleeve through at least one hole in the wall of the inner sleeve and each of which is adapted to cover at least two of the ports in the outer sleeve. Additionally, at least one of the said ports is connected to a jetting nozzle facing radially outwardly from the outer sleeve and at least one of the ports defines a radially outwardly facing flushing port wherein a jetting nozzle is followed axially along the cleaning device by a circumferentially spaced flushing port.

The cleaning device further comprises the obstructing means, which may be ball bearings, elongated cylindrical bars or a combination of both, which has a diameter substantially equal to the diameter of the through bore in the inner sleeve. Alternatively, the obstructing means may have progressively increasing diameter and the diameter of the through bore in the inner sleeve increases in steps to define a plurality of seating collars each of which accommodates a respective one of the said ball bearings. In another alternative, the obstructing means comprises sealing means for forming a fluid tight seal with the inner wall of the drill string down which it is dropped wherein sealing means is made of rubber and takes the form of at least one saucer shaped discs connected one behind the other to the rear end of the obstructing means by a short shaft. Additionally, the diameter of the through bore in the inner sleeve is constant from one end to the other. In another alternative, the obstructing means comprises either a ball, an elongated tubular member, or a combination of both, wherein the outer diameter of which is substantially the same as the inner diameter of the through bore in the inner sleeve and one end of which is closed, having at least one axially spaced through apertures in the side thereof which, when the obstructing means is dropped into the inner sleeve open onto at least one of the axially spaced ports in the side thereof, wherein the obstructing means has a diameter substantially equal to the inner diameter of the elongated tubular member and are adapted to be received therein to obstruct and close off the said axially spaced through apertures in the side thereof. Alternatively, the obstructing means may be the same diameter or it may have a progressively increasing diameter and the internal diameter of the tubular elongated member increases from bottom to top in steps to define a plurality of seating collars each of which accommodates a respective one of them.

The cleaning device further comprises pressure sensitive stop means comprise shear pins located at axially spaced intervals in the inner wall of the outer sleeve wherein the inner sleeve comprises a detachable ring at the lowermost end thereof which serves to shear the said shear pins. Additionally, a plurality of circumferential grooves are provided in the inner surface of the through bore in the outer sleeve, corresponding in number and axially spacing to the shear pins and a radially flexible tongue comprising spring steel and is detachably connected to the inner sleeve, is carried by the inner sleeve which is adapted to engage in each of said circumferential grooves in turn as the inner sleeve moves downward relative to the outer sleeve thereby ensuring correct alignment of the inner and outer sleeves from one position to the next.

The cleaning device further comprises an hydraulic braking system to absorb the energy of the inner sleeve as it moves downward relative to the outer sleeve from one position to the next, wherein the hydraulic brake comprises a spring and a series of collapsible compartments, each of which is connected to the other through a bleed hole, positioned inside the outer compartment, immediately beneath the inner sleeve.

The cleaning further comprises jetting nozzles wherein an elongated hollow tube one end of which extends through an aperture in the outer wall of the outer sleeve and the opposite end of which is connected to a piston having an aperture therein in alignment with the through bore in the tube, which piston is mounted in a cylinder formed in and opening into the inner wall of the outer sleeve and resilient biasing means for biasing the piston and hence the elongated hollow tube towards the end of the cylinder which opens into the inner wall of the outer sleeve. Additionally, ports are also provided in the inner sleeve immediately above and below the seating collar, and an axially extending slot is provided in the inner wall of the outer sleeve and the length of the axial position of which corresponds with that of the said ports in the inner sleeve, such that when the inner sleeve moves downwards relative to the outer sleeve the two ports are connected via the said slot thereby enabling cleaning fluid to be pumped through the cleaning device past the seating collar when this has been obstructed. Further, the cleaning device is connected to a drill string for insertion into a well bore.

DESCRIPTION OF THE DRAWING

Like reference numbers and designations in various drawings indicate like elements.

DETAILED DESCRIPTION

Figure 1:
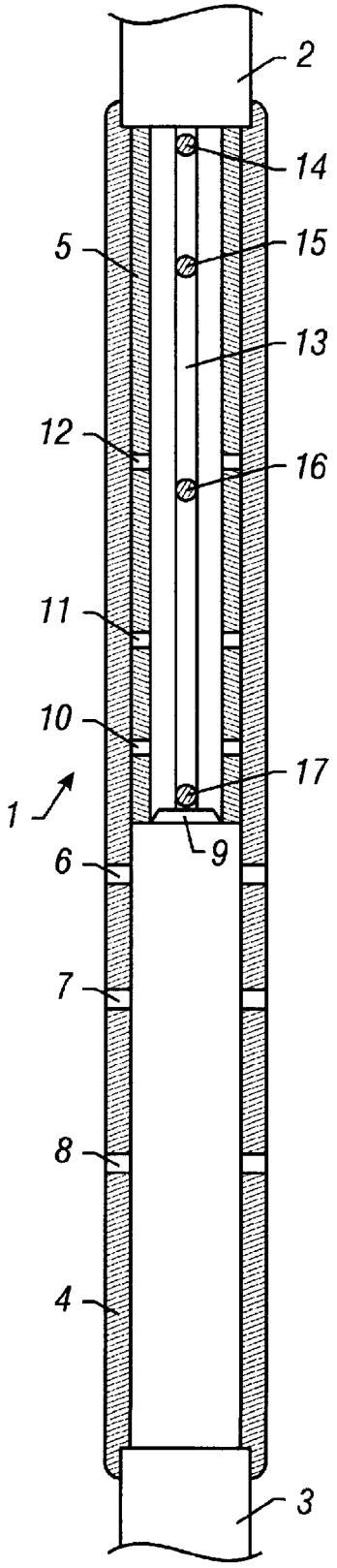
FIG. 1 shows a sectional view of a cleaning device immediately prior to use.

Referring to FIG. 1 of the accompanying drawings, there is shown a cleaning device 1 in accordance with the present invention connected between upper and lower sections 2 and 3 of drill string. The drill string takes the form of hollow piping through which cleaning fluid can be passed to the cleaning device from the surface of a well bore. Conveniently, the cleaning device is screwed onto the upper and lower sections 2 and 3 of drill string, although other connecting methods may be employed instead.

The cleaning tool 1 comprises an outer sleeve 4 and an inner sleeve 5 which is co-axial with and axially slidable within the outer sleeve 4. It will be apparent from the drawing that the outer diameter of the inner sleeve 5 is equal to or less than the internal diameter of the upper and lower sections 2 and 3 so that it may slide axially into and out of these freely. Between the inner wall of the outer sleeve 4 and the outer wall of the inner sleeve 5 fluid seals are provided to prevent cleaning fluid leaking from the cleaning device, but for clarity these have been omitted from the drawing. The outer sleeve 4, the inner sleeve 5 and the fluid seals between them are designed to withstand high pressure.

Located in the wall of the outer sleeve 4 are a first group of jetting nozzles 6, a group of flushing ports 7 positioned below the jetting nozzles 6, and a second group of jetting nozzles 8 positioned below the flushing ports 7. Although not readily apparent from the drawing both the first and the second group of jetting nozzles 6 and 8, and the flushing ports 7 are each circumferentially spaced around the outer sleeve 4.

The inner sleeve 5 is open at its upper and lowermost ends to allow for the passage of cleaning fluid therethrough from the upper section 2 of drill string to the lower section 3 of drill string. At the lower end of the inner sleeve 5 there is provided a seating collar 9 which is held in place by a pressure sensitive mechanism such as shear pins (not shown). As will become apparent below, whenpressure in excess of a predetermined level is applied to the seating collar 9, it is forced out of the inner sleeve 5.

At spaced intervals along the length of the inner sleeve 5, there are provided three groups of ports 10, 11 and 12. As with the jetting nozzles 6 and 8 and the flushing ports 7, the ports in each of the groups 10, 11 and 12 are circumferentially spaced around the inner collar. Furthermore, as will become apparent below the ports in each of the groups 10, 11 and 12 are axially aligned with a respective one of the jetting nozzles 6 and 8, and the flushing ports 7.

An axially extending slot 13 is provided in the inner sleeve 5 into which extend three shear pins 14, 15 and 16 at axially spaced intervals along the length of the slot. The shear pins are inserted into the slot through receiving holes in the outer sleeve 4. In the initial position of the cleaning device as shown in FIG. 1, it will be seen that the uppermost end of the slot 13 is supported on the uppermost end of the shear pins 14. It will also be seen that none of the ports 10, 11 and 12 is radially aligned with any of the jetting nozzles 6 and 8, or the flushing ports 7.

Figure 2:
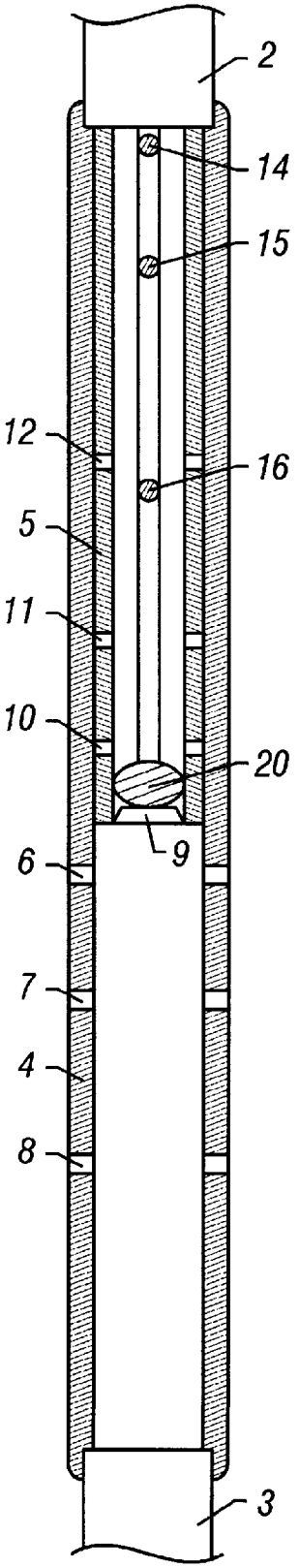
FIG. 2 shows a sectional view of the cleaning device in which an insert has been dropped down into the inner sleeve onto the seating collar.

Referring now to FIGS. 2–8 of the drawings operation of the cleaning device shown in FIG. 1 will be described. In order to commence operation of the cleaning device, cleaning fluid under high pressure is passed down the upper section 2 of the drill string, through the inner sleeve 5 and onward down through the lower section 3 of the drill string. Then as shown in FIG. 2 a ball 20 is dropped down the upper section 2 of the drill string into the inner sleeve 5. The diameter of the ball 20 is such that it is prevented from dropping out of the lowermost end of the inner sleeve 5 by the seating collar 9. The ball 20 prevents further cleaning fluid from passing through the inner sleeve 5. Now by increasing the pressure of the cleaning fluid in the upper section 2 of the drill string a downward pressure is applied to the inner sleeve 5 sufficient to cause the uppermost shear pin 14 to shear. This releases the inner sleeve 5 and allows it to slide down inside the outer sleeve 4 to the position shown in FIG. 3.

Figure 3:
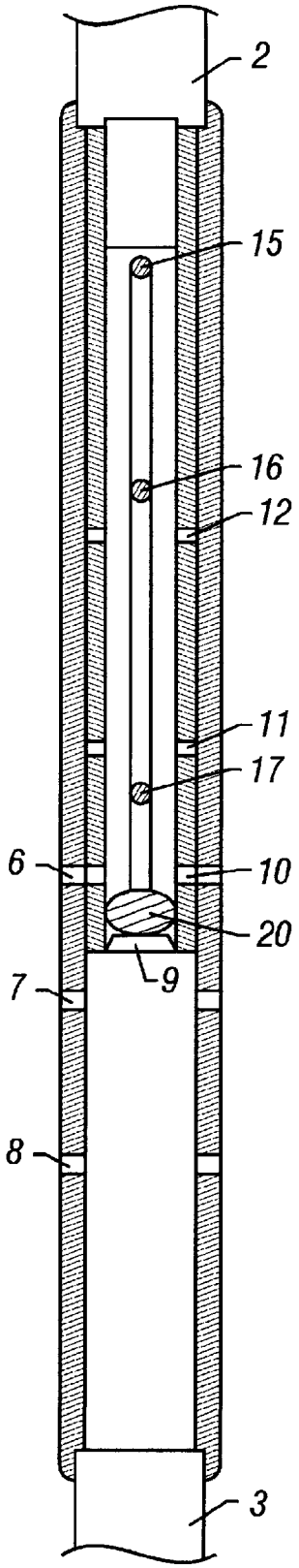
FIG. 3 shows a sectional view of the cleaning device in which the inner sleeve has dropped down relative to the outer sleeve to a first jetting position.

As shown in FIG. 3 the ports 10 in the inner sleeve 5 are aligned with the jetting nozzles 6 in the outer sleeve 4. Cleaning fluid under pressure can now be sprayed out through the jetting nozzles 6 onto the wall of the well bore casing. Further downward progress of the inner sleeve 5 in line within the outer sleeve 4 is prevented by the next shear pin 15 in line with the elongated slot 13.

Figure 4:
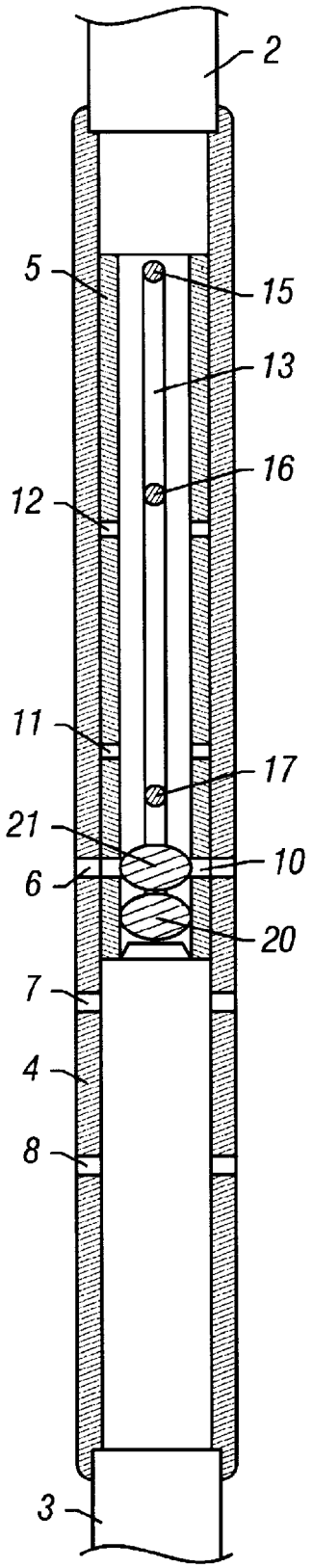
FIG. 4 shows a sectional view of the cleaning device in the first jetting position in which a second insert has been dropped into the inner sleeve.

Once jetting has been completed it is necessary to flush the jetted area of the casing wall with cleaning fluid. As shown in FIG. 4, this is achieved by dropping a second ball 21 down the upper section 2 of the drill string into the inner sleeve 5. The second ball 21 comes to rest on the first ball 20 and prevents further jetting. Again there is a build up of pressure in the upper section 2 of the drill string and this time this causes shear pin 15 to shear. The inner sleeve 5 is now free to slide down inside the outer sleeve 4 to the position shown in FIG. 5.

Figure 5:
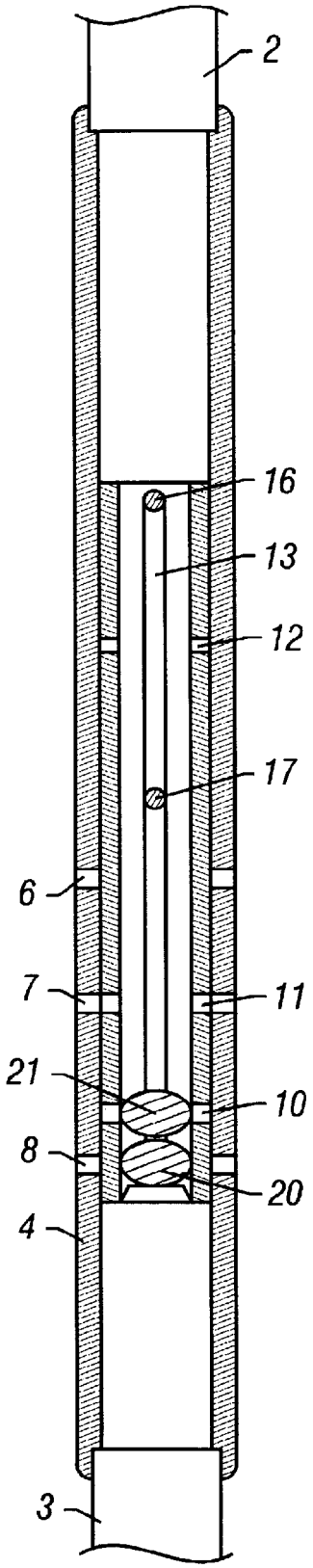
FIG. 5 shows a sectional view of the cleaning device in which the inner sleeve has dropped down further relative to the outer sleeve to a first cleaning fluid circulating position.

As shown in FIG. 5, the ports 11 in the inner sleeve 5 are now aligned with the flushing ports 7 in the outer sleeve 4. Cleaning fluid under pressure is now circulated through the flushing ports 7 around the well bore casing immediately below the jetting nozzles 6. This time further downward progress of the inner sleeve 5 within the outer sleeve 4 is arrested by the next shear pin 16 in line in the elongated slot 13.

Figure 6:
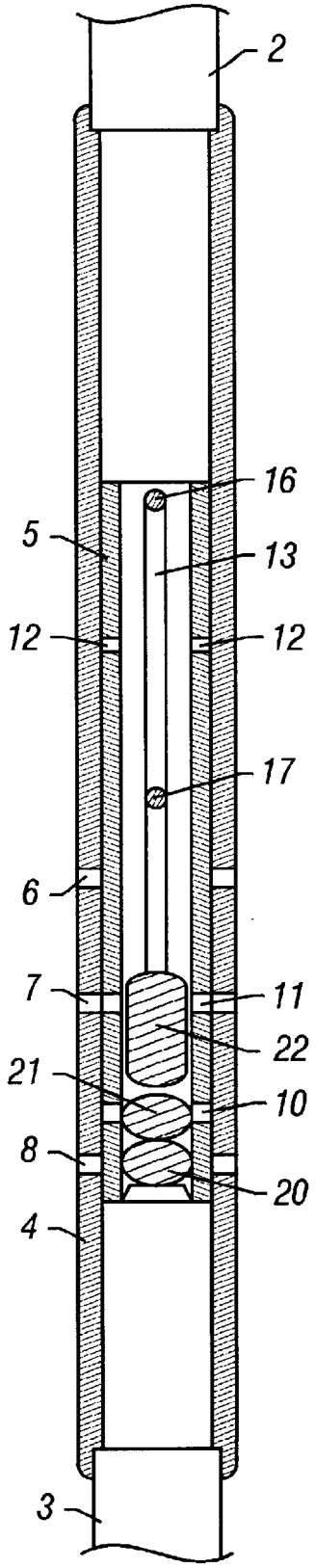
FIG. 6 shows a sectional view of the cleaning device in which a third insert has been dropped into the inner sleeve.

Once the flushing operation has been completed a further jetting operation can be carried out further down the well bore casing using the jetting nozzles 8. To achieve this the flushing operation must be terminated and this is achieved by dropping an elongated cylindrical bar 22 down the upper section 2 of the drill string as shown in FIG. 6. The length of the bar 22 is such that when it comes to rest on the ball 21 it obstructs the ports 11 in the inner sleeve. Once again there is a build up of pressure in the upper section 2 of the drill string which causes the shear pin 16 to shear. Now the inner sleeve is free to slide down inside the outer sleeve to the position shown in FIG. 7.

Figure 7:
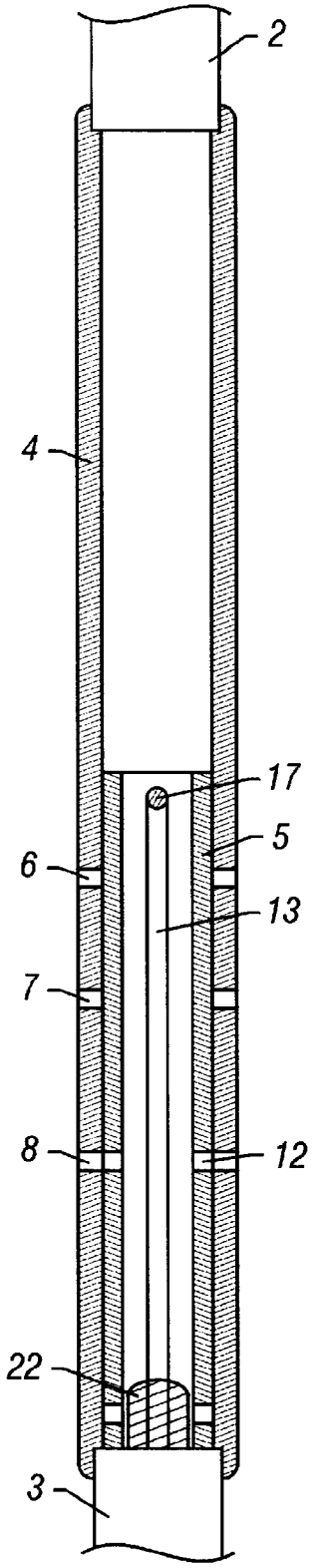
FIG. 7 shows a sectional view of the cleaning device in which the inner sleeve has dropped down further relative to the outer sleeve to a second jetting position.
Figure 8:
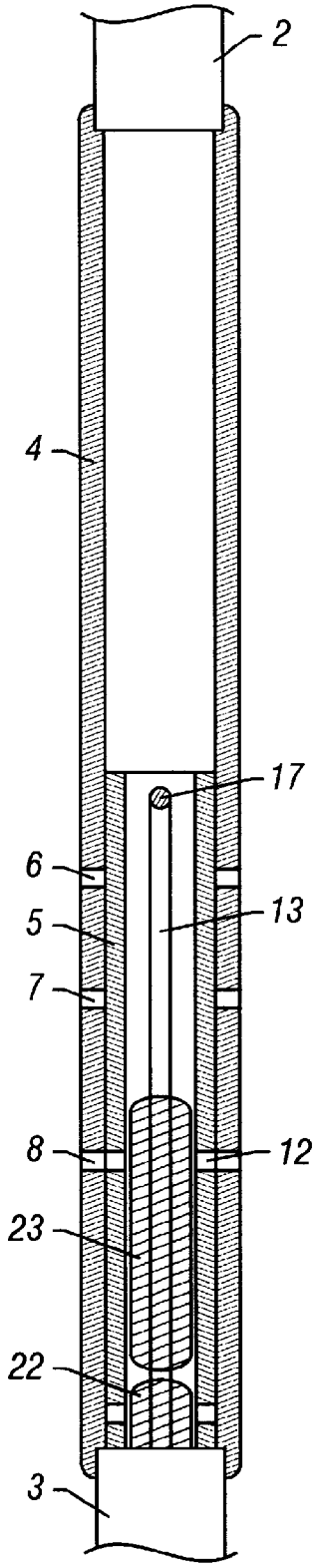
FIG. 8 shows a sectional view of the cleaning device in which a fourth insert has been dropped into the inner sleeve.

For convenience of illustration the inner sleeve 5 has not been shown in the previous figures of a length sufficient to accommodate the full length of the elongated slot 13 required to accommodate alignment of the second jetting nozzles 8 with the final ports 12. This is remedied in FIGS. 7 and 8. As shown in FIG. 7, the ports 12 in the inner sleeve are now aligned with the jetting nozzles 8 in the outer sleeve 4. Cleaning fluid under pressure passes through the jetting nozzles 8 onto the wall of the well bore casing immediately opposite. This time further downward movement of the inner sleeve, inside the outer sleeve 4 is prevented by a retaining pin 17 located in the elongated slot 13. This retaining pin 17 serves to prevent the inner sleeve 5 from becoming detached from the outer sleeve 4 once this cleaning operation has been completed.

Further jetting and flushing operations can be carried out by the simple expedient of extending the length of the cleaning device and providing more jetting nozzles and flushing ports in the outer sleeve with corresponding ports in the inner sleeve.

However, once the final jetting operation has been completed, a free and unimpeded flow of cleaning fluid must be provided to the bottom of the lower section 3 of the drill string. To achieve this yet another elongated cylindrical bar 23 is dropped down the upper section 1 of the drill string into the inner sleeve 5. The length of this is such that when it comes to rest on the bar 22 it closes the ports 12 thereby preventing further jetting.

Once again there is a build up of pressure in the upper section 2 of the drill string, but this time instead of this resulting in the inner sleeve 5 moving further down inside the outer sleeve 4, the shear pins retaining the seating collar 9 give way. This allows the seating collar 9 and the balls and bars 20, 21, 22 and 23 to drop down to the bottom of the lower section 3 of drill string. The inner sleeve 5 is now open at both ends and cleaning fluid can be pumped through it freely. A catch assembly is provided at the lower end of the lower section 3 of the drill string to catch the collar 9, balls 20 and 21 and bar and 23.

Figure 9:
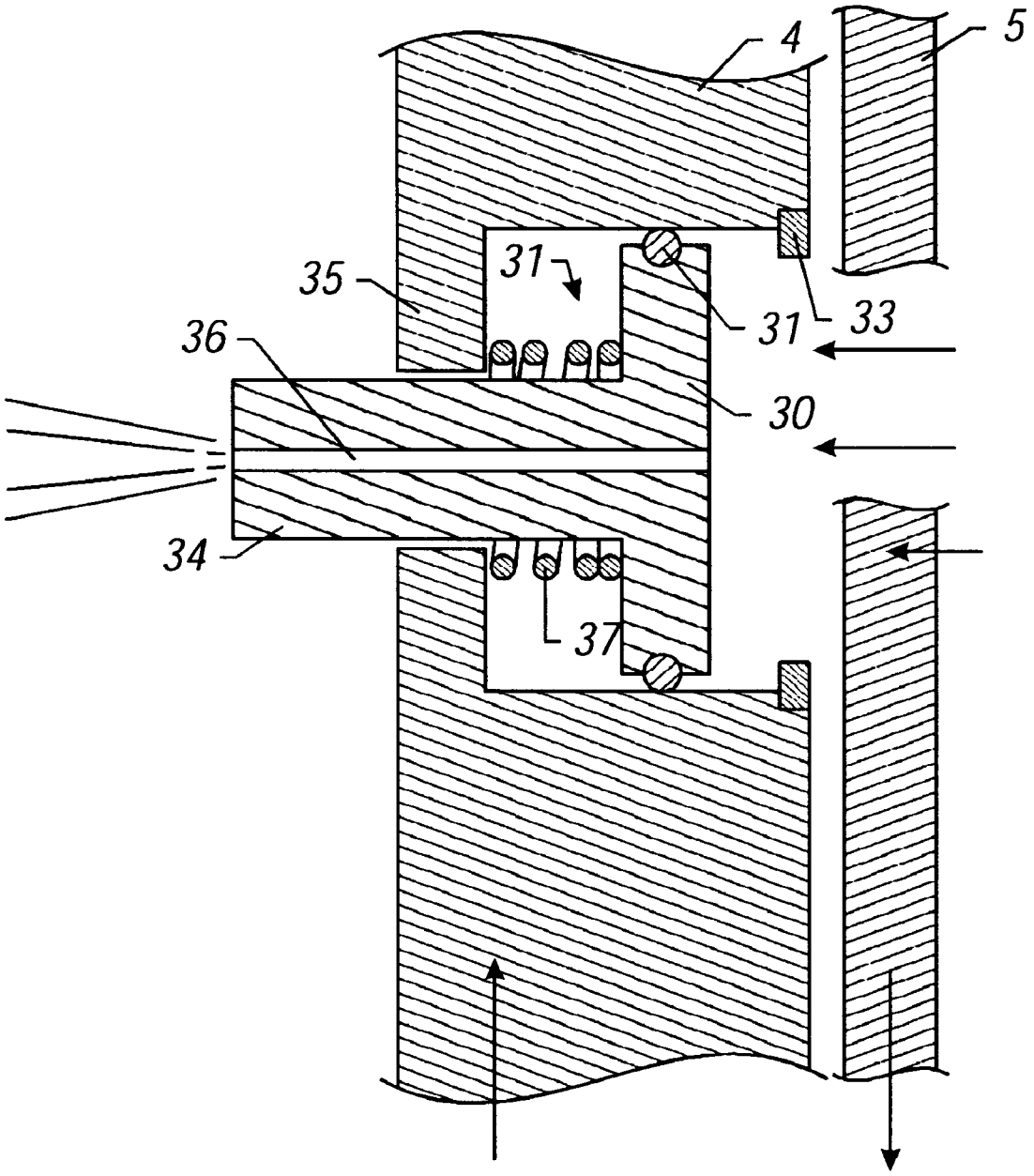
FIG. 9 shows a detail of a jetting nozzle mounted in the wall of the outer sleeve.

Referring to FIG. 9 of the accompanying drawings, there is shown an enlarged view of one of the jetting nozzles employed in the cleaning device in accordance with the present invention. The jetting nozzle comprises a piston 30 which is mounted in a cylinder 31 cut into the inner wall of the outer sleeve 4. An O-ring 32 around the periphery of the piston 30 ensures a fluid tight seal with the walls of the cylinder 31 and a circlip 33 around the open end of the cylinder 31 serves to retain the piston 30 thereon.

A hollow elongated tube 34 is connected to the inner face of the piston 30 and projects through an aperture of approximately the same diameter in the end wall 35 of the cylinder 31, that is to say the outer wall of the outer sleeve 4. The bore 36 through the tube 34 also extends through the piston and opens in the outer face thereof to define a jetting orifice.

A compression spring 37 mounted on the tube 34 between the end wall 35 and the inner face of the piston 30 serves to ensure that the piston 30 is normally biased towards the restraining circlip 33. This of course, has the effect of retracting the face end of the tube 34 as far as is possible in towards the outer wall of the outer sleeve 4.

In use, when the open end of the cylinder 31 is aligned with a port 38 in the inner sleeve 5, the piston 30 is subjected to the pressurized cleaning fluid therein. The pressure of the cleaning fluid on the piston 30 opposes the resilient biasing action of the compression spring 37 and causes the piston 30 to move into the cylinder 31. This in turn causes the free end of the tube 34 to move outwardly from the outer wall of the outer sleeve 4. The distance by which the tube 34 extends from the outer wall of the outer sleeve 4 is a function of the pressure in the cleaning fluid. Thus by varying this pressure, the distance to which the tube 34 is extended can also be varied thereby allowing the cleaning device to be used effectively in well bore casings of varying diameter.

As an alternative to "blowing out" the seating collar which supports the balls and bars which serve to obstruct the ports in the inner sleeve once all of the jetting and flushing operations have been completed to allow a free flow of cleaning fluid through the inner sleeve and out the lower end of the cleaning device, a bypass arrangement may be provided in the cleaning device. The bypass arrangement allows cleaning fluid to pass down through the inner sleeve to a further port positioned immediately above the seating collar, into a passage in the inner wall of the outer sleeve or, as is more likely, into a passage in the inner wall of the lower section of the drill string. The passage leads to a further port in the inner sleeve positioned below the collar or to a point below the lower end of the inner sleeve.

When all of the jetting and flushing operations have been completed an insert is dropped into the inner sleeve to stop the last flushing/jetting operation. However, this time, instead of causing the seating collar to blow out, it causes yet another shear pin in the elongated slot to shear. The inner sleeve is now free to drop down inside the outer sleeve to a point where the port above the seating collar and the bypass passage align. In order to prevent cleaning fluid from passing through this port as it passes the jetting nozzles and the flushing ports in the outer sleeve it can be radially off-set relative to these. In order to allow cleaning fluid to reach this port past the inserts, they may be hollowed out or a bypass passage may be provided in the inner wall of the inner sleeve leading from a point above the uppermost port therein to the port immediately above the seating collar.

This arrangement allows the inserts to be retained in the cleaning device after the cleaning operation has been completed and does away with the need for a catching attachment as the end of the lower section of the drill string.

Figure 10A:
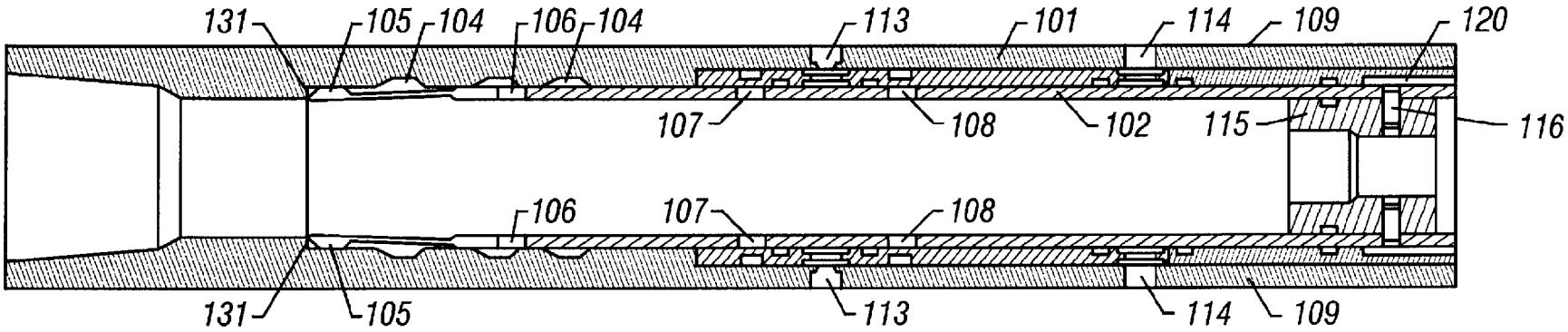
FIGS. 10A and 10B show an upper and lower sectional view respectively of a cleaning device immediately prior to use.
Figure 10B:
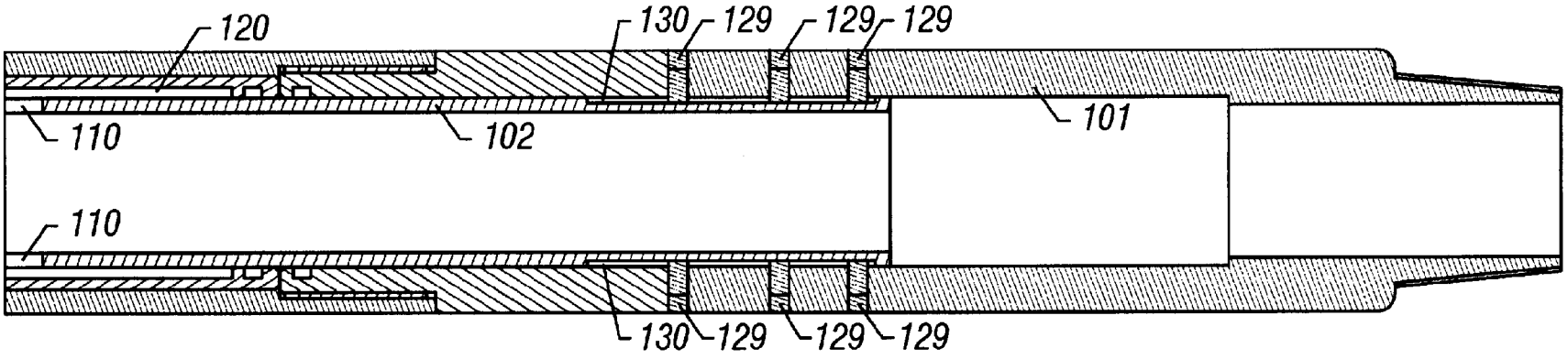

Referring now to FIGS. 10A to 10B of the drawings, there is shown another cleaning device in accordance with the present invention at different stages in its operation from being inserted in a well bore to immediately prior to being withdrawn therefrom. The cleaning device shown essentially comprises an outer sleeve 101 and an inner sleeve 102 which is co-axial with and axially slidable within the outer sleeve. A group of circumferentially spaced jetting nozzles 113 and a group of circumferentially spaced side circulation ports 114 are provided in the outer sleeve 101 through which, cleaning fluid is pumped to clean the walls of a well bore. To this end, the inner sleeve 102 moves axially downwards within the outer sleeve 101 to a new position after each operational stage is completed. In order to ensure that the inner sleeve 102 always takes the correct position within the outer sleeve 101, the inner wall of the outer sleeve 101 is provided with three axially spaced circumferential grooves 104 at the end thereof which normally lies uppermost in use. The end of the inner sleeve 102 which normally lies uppermost is provided with a plurality of radially flexible lugs or tongues 105 which are adapted to engage in each of the grooves 104 in turn as the inner sleeve 102 moves downwards inside the outer sleeve 101.

In the wall of the inner sleeve 102 there are provided five groups of ports 106, 107, 108, 109 and 110, each of which is axially spaced from the others. The ports comprising each of groups 106, 107 and 108 are circumferentially spaced around the wall of the inner sleeve 102 in axial alignment with the jetting nozzles 113 and side circulation ports 114.

The inner sleeve 102 is open throughout its length. However, towards the middle there is provided a seating collar 115 which is held in position by means of shear pins 116. The ports 109 and 110 lie in the wall of the inner sleeve respectively above and below the seating collar 115.

An axially extending circumferential channel 120 is provided in the inner wall of the outer sleeve 101. The position of the channel 120 is such that at a given point in the operation of the cleaning device, both of the ports 109 and 110 are connected together through it. This allows cleaning fluid entering the uppermost end of the cleaning device to circumvent the seating collar 115 (when blocked) and pass out through the lowermost end thereof.

Three groups of shear pins 129 are provided in the outer sleeve 101. Each shear pin is mounted in a respective bore in the outer sleeve 101 and extends into an axially extending channel 130 in the outer surface of the inner sleeve 102. The axial spacing of each group of shear pins 129 from the others corresponds with that of the circumferential grooves 104 in the uppermost end of the outer sleeve 101.

In use, the uppermost end of the outer sleeve 101 of the cleaning device is connected to a drilling string down which cleaning fluid can be pumped at high pressure to perform specific jetting and circulation operation.

As shown in FIGS. 10A and 10B, the cleaning device is initially supplied with the uppermost end of the inner sleeve 102 located against a shoulder 131 formed at the uppermost end of the outer sleeve 101. It is maintained in this position by seals located at intervals along its length. In this position, and it should be noted, that the through bore in the seating collar 115 is unobstructed, the drill string and a tool assembly (as part of the drill string) connected to the lowermost end of the cleaning device can be pressure tested if required.

Figure 11A:
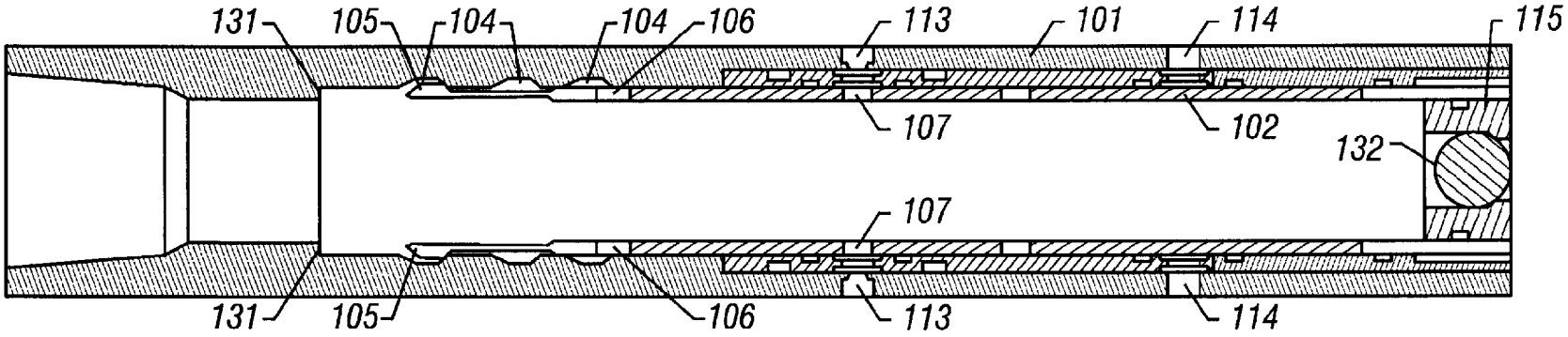
FIGS. 11A and 11B show an upper and lower sectional view respectively of a cleaning device after the insertion of a first insert onto the lowermost seating collar of the sliding inner sleeve.
Figure 11B:
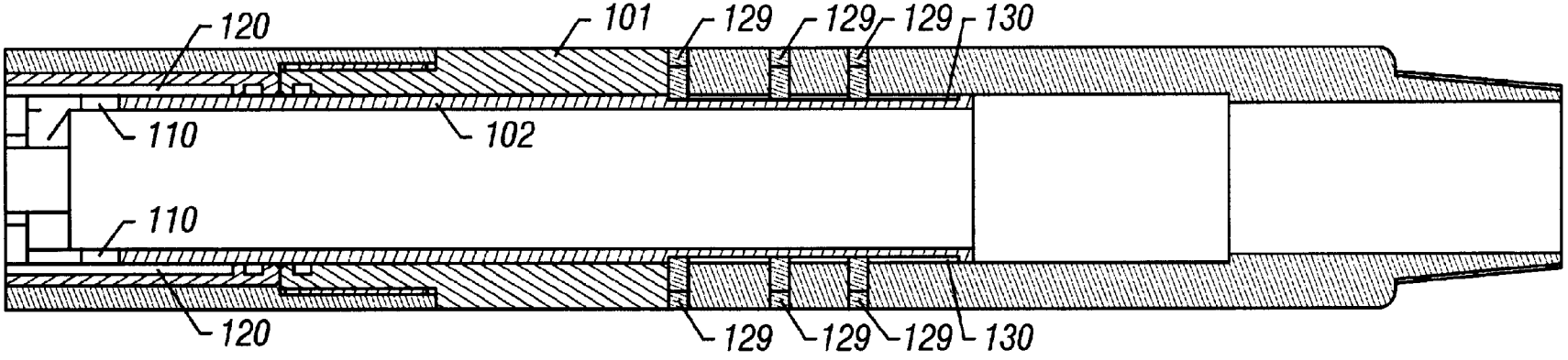
Figure 12A:
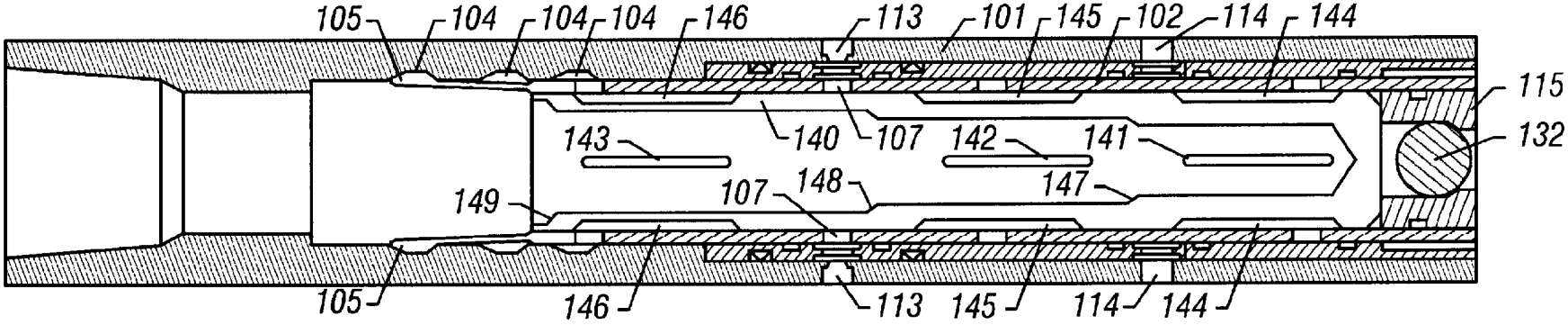
FIGS. 12A and 12B show an upper and lower sectional view respectively of a cleaning device after the insertion of a plunger.
Figure 12B:
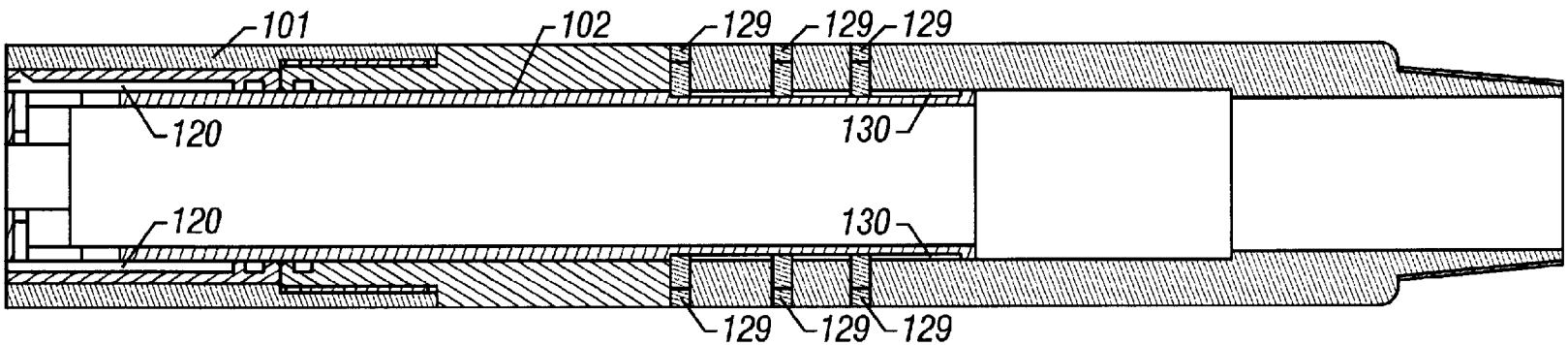
Figure 13A:
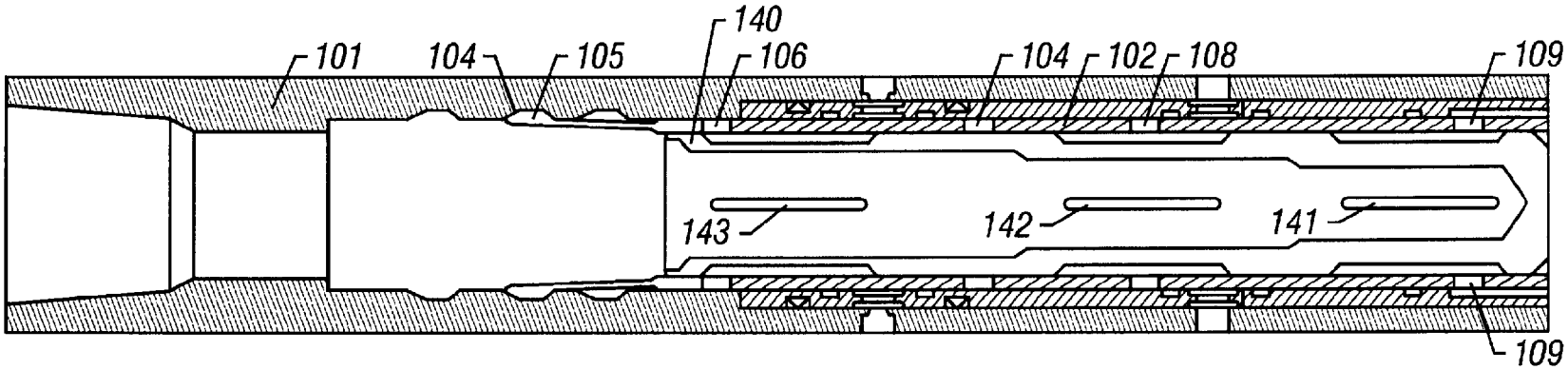
FIGS. 13A and 13B show an upper and lower sectional view respectively of the cleaning device after the inner sleeve has dropped further downwards within the outer sleeve.

To commence the first jetting operation a ball 132 is dropped down the drill string into the cleaning device and comes to rest on the seating collar 105 as shown in FIGS. 11A and 11B. The ball 132 obstructs the through bore in the seating collar 105 with the result that a relatively small amount of pressure in the cleaning fluid pumped into the drill string will move the inner sleeve 102 downwards relative to the outer sleeve 101. The inner sleeve 102 comes to rest relative to the outer sleeve 101 with the uppermost end of the circumferential channel 130 supported against the first group of shear pins 129. In this position the first group of jetting nozzles 113 lies immediately adjacent to and is radially aligned with the ports 107. Cleaning fluid is now pumped through this first group of jetting nozzles 113 to complete the first jetting operation. Typically the pressure of the cleaning fluid in the drilling string is 4000 psi (at the surface) for this operation.

Figure 14A:
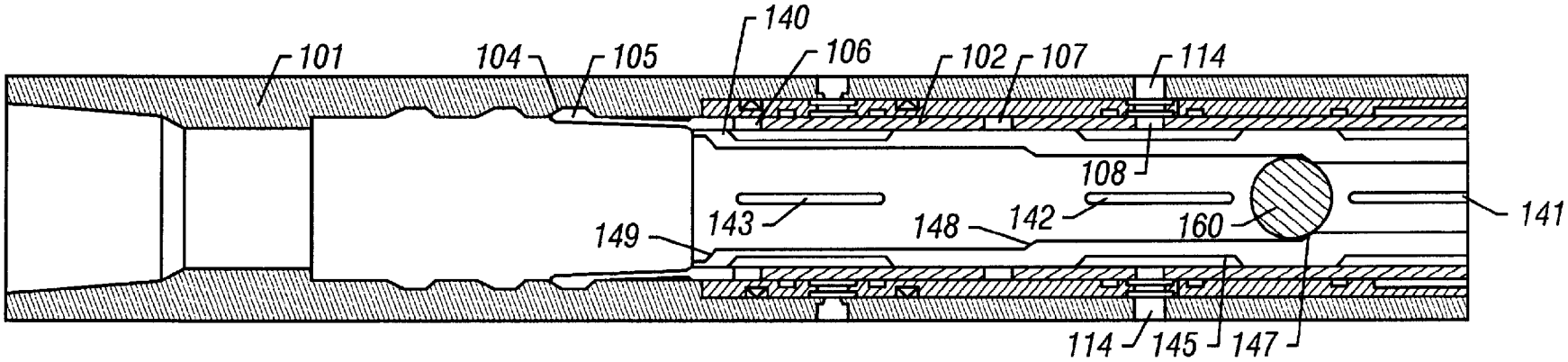
FIGS. 14A and 14B show an upper and lower sectional view respectively of the cleaning device after the insertion of a second insert onto a seating collar within an internal bore of the plunger.
Figure 13B:
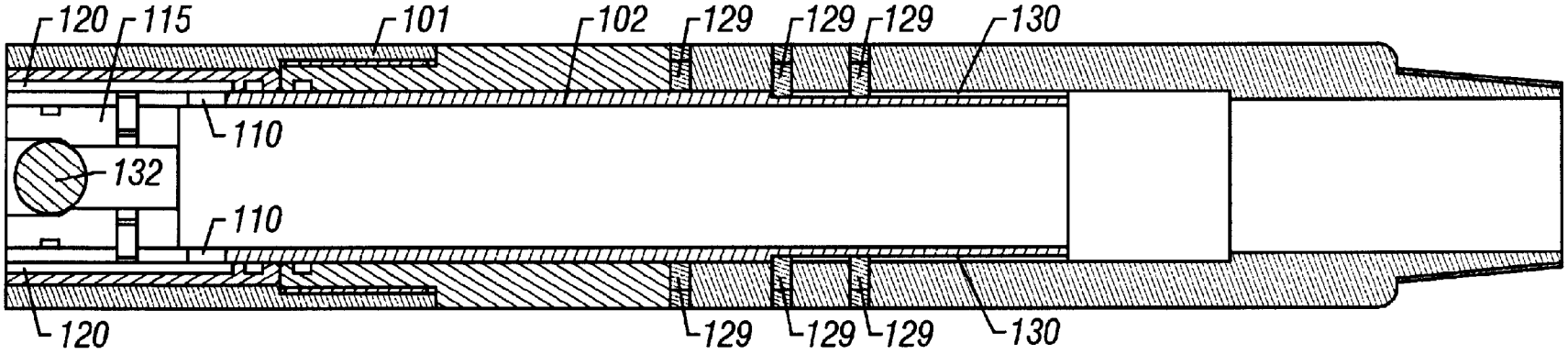
Figure 14B:
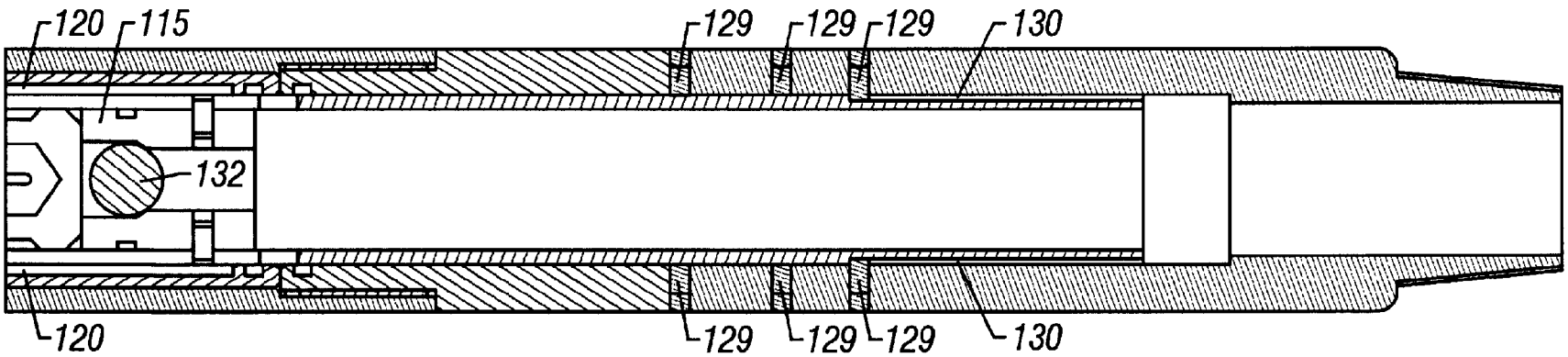

As shown in FIGS. 12A, 12B, 13A and 13B, once the first jetting operation has been completed a purpose designed plunger 140 is dropped down the drilling string into the inner sleeve 102 of the cleaning device. The plunger 140 is closed at its lowermost end, but open at the uppermost end. Three groups of four circumferentially spaced slots 141, 142 and 143 are provided at axially spaced intervals along the length of the plunger 140. The slots forming each of the groups 141, 142 and 143 open into a respective axially extending circumferential cut-out 144,145 and 146 in the outer wall are, in turn open to the circumferential channel 120 in the inner surface of the outer sleeve 101. Finally, the channel 120 is open to the ports 110 in the wall of the inner sleeve 102 immediately below the seating collar 115. In this way the first ball 132 is by-passed to allow cleaning fluid to circulate through the bottom of the cleaning device. As shown in FIGS. 14A and 14B, the next stage in the operation of the cleaning device a second ball 160 is dropped down the drilling string onto the lowermost seating collar 147. The pressure of the cleaning fluid in the drilling string is again increased, this time to shear the second group of shear pins 129, and the inner sleeve 102 moves further downwards relative to the outer sleeve 101. The inner sleeve 102 comes to rest with the flexible lugs 105 engaging in the third groove 104 in the outer sleeve and resting on the third group of shear pins 129. In this position the side circulation ports 114 in the outer sleeve 101 are open to the ports 108 in the inner sleeve 102, which are, in turn open to the slots 142 in the plunger 140 via the circumferential cut-out 145. In this position cleaning fluid can be circulated out through the sides of the cleaning device. This side circulation operation is shown in FIGS. 14A and 14B.

This operation of side circulation may not always be required. If so the second set of shear pins is removed and replaced with a set of plugs and during the cleaning operation the second ball 160 is not dropped into the cleaning device. Instead, when the bottom circulation is complete the cleaning device goes straight to the next cleaning operation which is a second jetting operation.

Figure 15A:
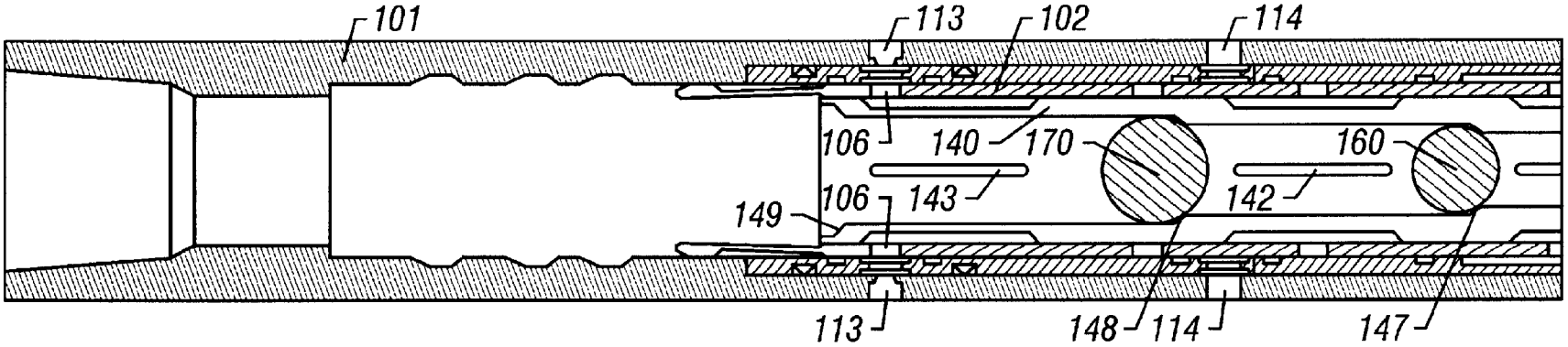
FIGS. 15A and 15B show an upper and lower sectional view respectively of the cleaning device of after the insertion of a third insert onto a second seating collar within the internal bore of the plunger.
Figure 16A:
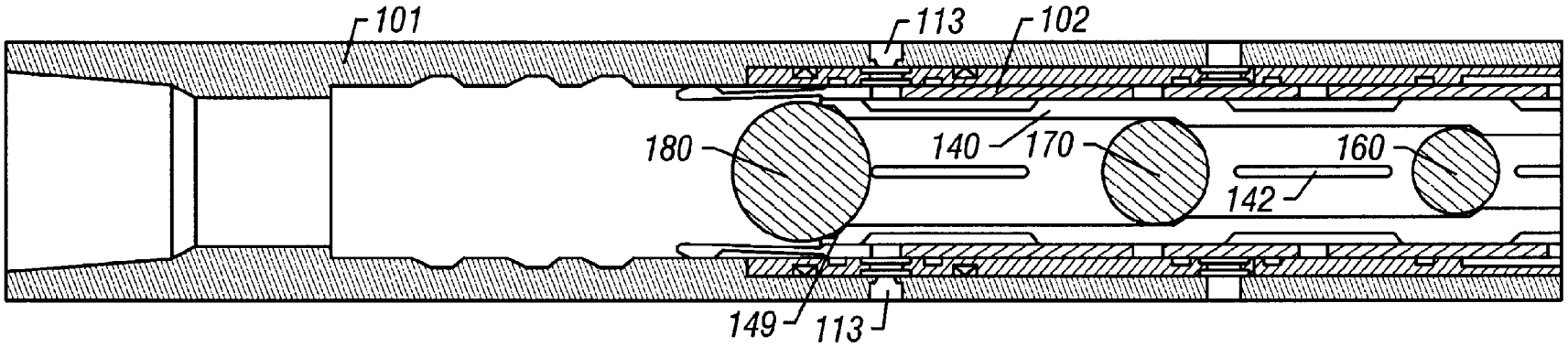
FIGS. 16A and 16B show an upper and lower sectional view respectively of the cleaning device after the insertion of a fourth insert onto a third seating collar within the internal bore of the plunger.
Figure 15B:
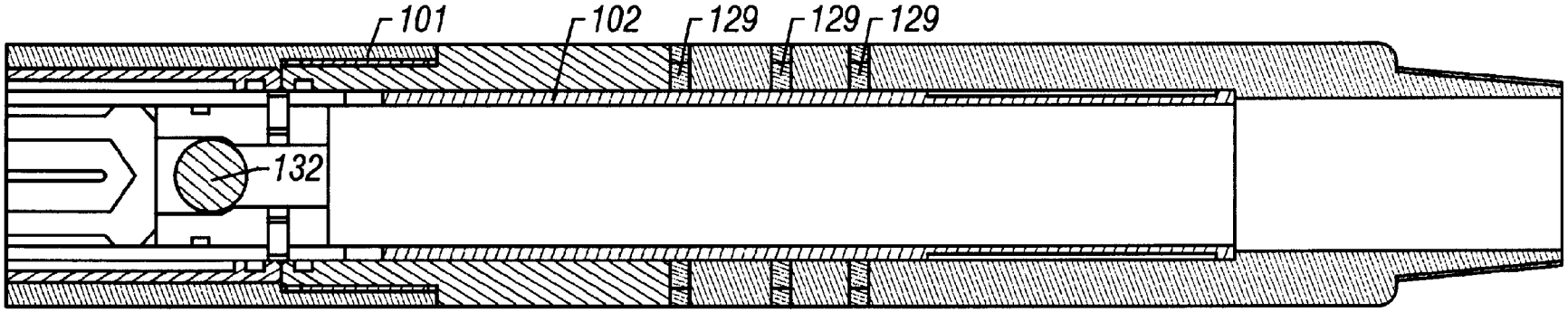
Figure 16B:
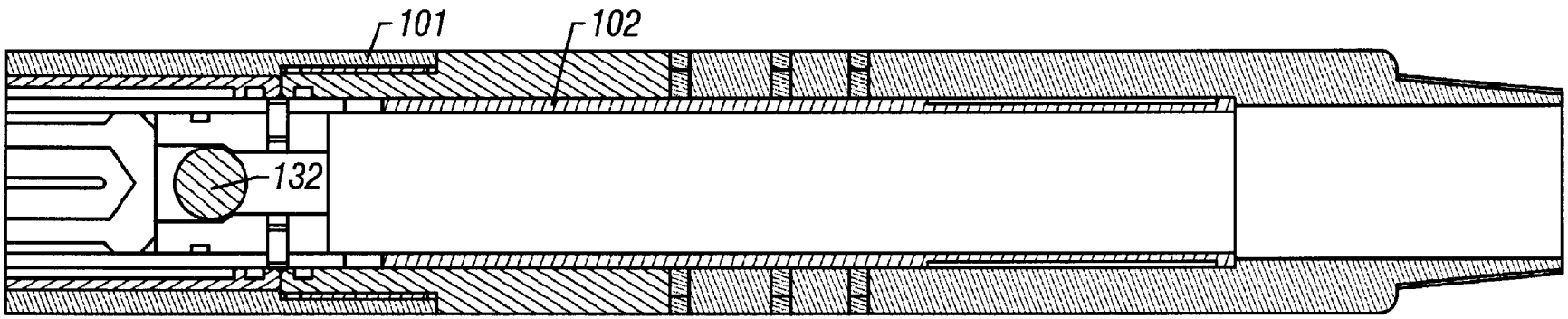

As shown in FIGS. 15A and 15B, during the second jetting operation a third ball 170 (or second is the option side circulation operation is not required) is dropped into the drilling string. The third ball 160 comes to rest on the second seating collar 148 of the plunger 140 and cuts off flow to the circulation ports 114 (or to the slots 142 if side circulation is not required). An increase in pressure of the cleaning fluid within the drilling string causes the third set of shear pins 129 to shear and allows the inner sleeve 102 to move downwards relative to the outer sleeve 101 to the position shown in FIGS. 15A and 15B.

In this new position the uppermost slots 143 in the wall of the plunger 140 open onto the ports 106 which are in turn open onto the jetting nozzles 113. The second jetting operation can now be completed.

Should it be found necessary to again circulate cleaning fluid through the cleaning device to the bottom thereof a fourth ball 180 is dropped down the drilling string onto the uppermost seating collar 149 of the plunger 140. This has the effect of sealing off the jetting nozzles 113. Now the pressure in the drilling string is increased substantially to shear the shear pins 116 holding the seating collar 115 in the inner sleeve 102. This allows the seating collar 115, the plunger 140 and all the balls 132, 160, 170 and 180 to pass out through the bottom of the cleaning device and down the drill string into a junk basket at the bottom of the drilling string. Cleaning fluid is now free to circulate again through the cleaning device.

Figure 17:
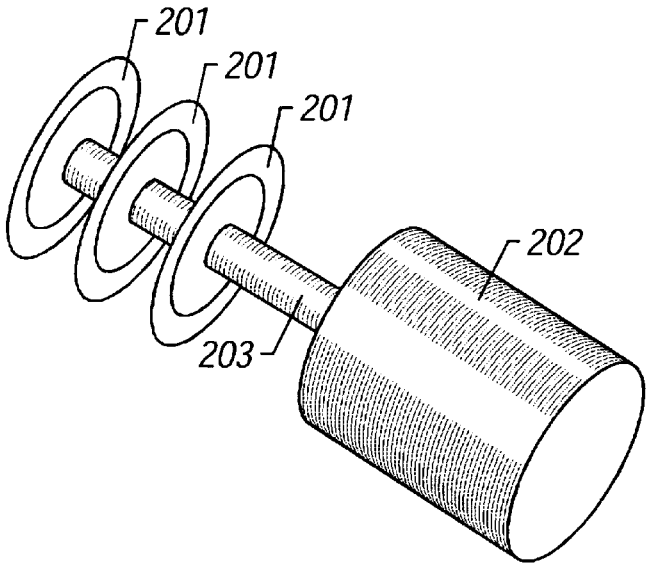
FIG. 17 shows an embodiment of an obstructing insert dropped into the cleaning device.

Referring to FIG. 17, there is shown an alternative embodiment of the obstructing means comprising three saucer shaped discs 201 connected one behind the other to the rear end of an elongated plug 202 by a short shaft 203. The seals 201 are made of rubber or a similar material. The seals 201 enable the obstructing means to be propelled down a drill string into the cleaning device under hydraulic pressure instead of relying upon gravity. This is useful for overcoming obstructions in the drill string which prevent the obstructing means from falling under gravity because the obstructing means can be propelled under pressure through these. It is essential in the case of horizontal well bores in which the well bore goes from being vertical to horizontal through a radius of a section. Clearly, in these horizontal well bores it is not possible to rely on gravity to ensure that each obstructing means is carried to the cleaning device. The seals 201 allow the obstructing means to be propelled under pressure along the drill string and into the cleaning device.

By providing two or more saucer shaped sealing discs 201 positioned one behind the other to the rear of the obstructing means it is possible to ensure that if one of them fails, either through wear and tear or because an excess of hydraulic pressure blows it inside out, that it does not become stuck in the drilling string. However, only one may be used if the circumstances warrant this. Furthermore, the short connecting shaft 203 between the sealing discs 201 and the plug 202 gives stability as the obstructing means moves along the length of the drilling string to the cleaning device.

In addition to or as an alternative to the tongue and groove braking means, the cleaning device may comprise an hydraulic braking system to absorb the energy of the inner sleeve as it is propelled within the inner sleeve from one position to another. In this regard, it must be borne in mind that the potential energy within the column of hydraulic fluid as it is pressurized to blow out the shear pins is substantial and may, in certain circumstances simply propel the inner sleeve out the bottom end of the outer sleeve.

Figure 18:
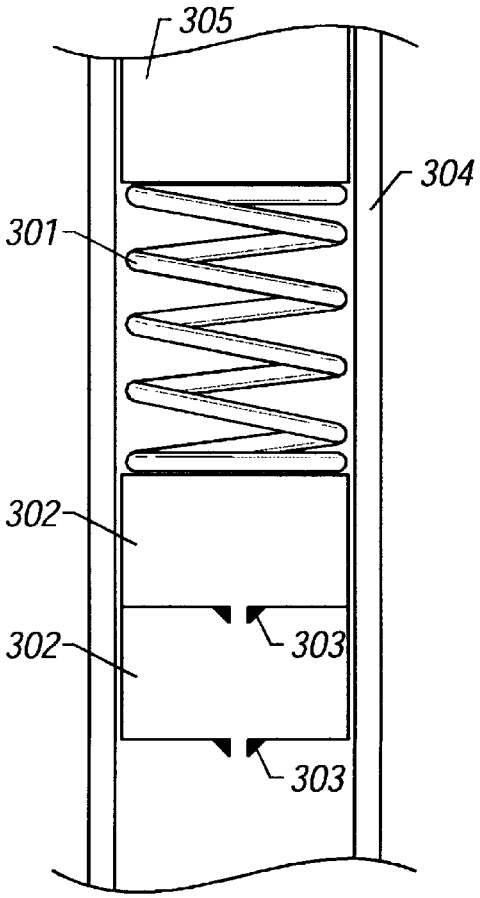
FIG. 18 shows a hydraulic brake for use in the cleaning device.

An illustration of just such an hydraulic brake is shown in FIG. 18. This comprises a spring 301 and a series of collapsible compartments 302, each of which is connected to the other through a bleed hole 303, positioned within the outer sleeve 304 and beneath the inner sleeve 305. When the first shear pin (not shown) is sheared the inner sleeve 305 is propelled downwards onto the spring 301 causing the first compartment 302 to collapse. As the first compartment 302 collapses fluid in it is expelled through the bleed hole into the second compartment. In this way, energy in the column of fluid above the inner sleeve which is not immediately vented when the inner sleeve reaches the next required position is absorbed.

The same occurs for each subsequent position of the inner sleeve. Each time the next compartment in line being collapsed in a controlled fashion by the expressing of fluid through the bleed hole in it.

Figure 19:
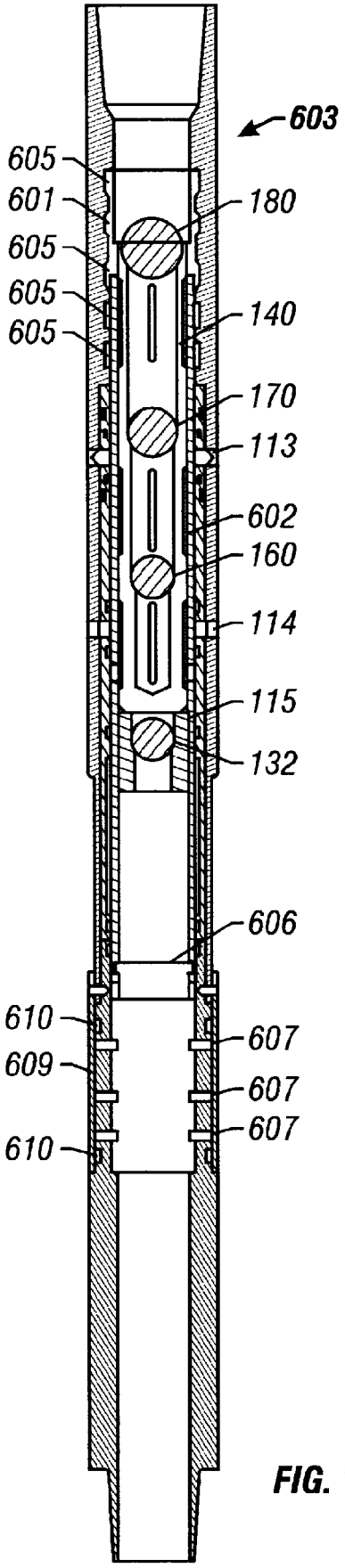
FIG. 19 shows a cross sectional view of a cleaning device.

Referring now to FIG. 19 of the drawings, there is shown a sectional view of a cleaning device which is essentially identical to the embodiment described previously with reference to FIGS. 10–16. It differs in the following respects.

Figure 20:
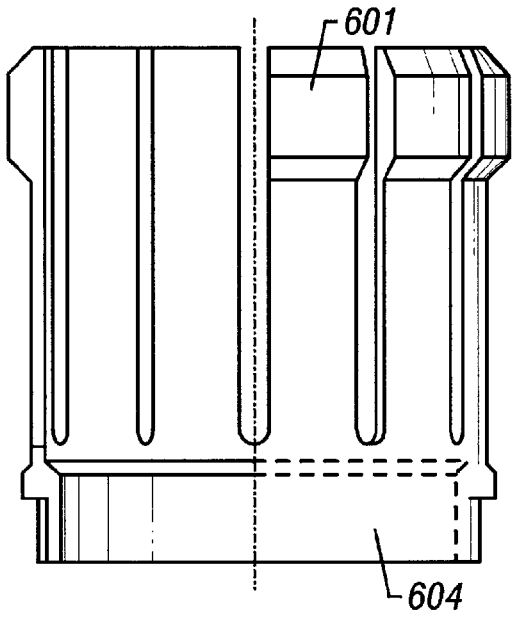
FIG. 20 shows a partial cross sectional view of a detachable tongue carrying ring of a cleaning device.

First, it will be seen that the radially flexible lugs or tongues 601 (corresponding to 105 in FIGS. 10–16) which serve to brake and arrest the downward movement of the inner sleeve 602 relative to the outer sleeve 603 from one position to the next form part of a screw threaded collet or ring 604 which is served into the uppermost end of the inner sleeve 602. An enlarged view of the collet 604 is shown in FIG. 20.

By making the collet 604 detachable from the inner sleeve it can be replaced when it becomes worn. Moreover, it can be made from a different material from the inner sleeve, such as spring steel. This ensures that the tongues 601 have a high degree of resilience for engaging with the inner wall of the outer sleeve 603 and, in particular, in the grooves 605 provided therein.

Second, it will be seen that a detachable collet or ring 606 is screw threadedly connected to the lowermost end of the inner sleeve 602. This detachable ring 606 is comprised of hardened steel and it serves the dual purpose of supporting the inner sleeve 602 on each group of axially spaced shear pins 607 in turn and also to shear each group of axially spaced shear pins 607, as the inner sleeve moves downward relative to the outer sleeve 603 from one position to the next.

It has been found that over a period of use the leading edge of the inner sleeve becomes worn and damaged by the shear pins. In the design of FIGS. 10–16, the whole of the inner sleeve needs to be replaced when this wear and damage becomes significant. In contrast, only the detachable ring 606 needs to be replaced in the design of FIG. 19.

It is also worth noting that the innermost ends of the shear pins 607 projecting from the inner wall of the outer sleeve 603 are not covered by an extension of the inner sleeve 602 as with the design of FIGS. 10–16. As each group is sheared, the sheared off ends simply drop out of the bottom of the cleaning device to a catcher at the bottom of the drilling string. Furthermore the outer ends of the shear pins 607 are covered by a removable cover plate 609 having an O-ring seal 610 at the top and at the bottom which ensures a fluid tight seal with the outer wall of the outer seal. The cover plate 609 retains the shear pins in place in the wall of the outer sleeve and ensures that cleaning fluid under pressure cannot escape past the shear pins.

A number of embodiments of the invention have been described. Nevertheless, it will be understood that various modifications may be made without departing from the spirit and scope of the invention. Accordingly, other embodiments are within the scope of the following claims.

What is claimed:

1. A cleaning device for a well bore which is adapted to be connected to a drill string for insertion into the well bore and through which cleaning fluid is pumped, comprising:

an elongated outer sleeve having an axially extending through bore therein;

means for connecting one end of the outer sleeve to the drill string;

at least one port in the side wall of the outer sleeve, wherein each port is axially spaced along the outer sleeve;

an elongated inner sleeve having an axially extending through bore therein and which is co-axial with and axially slidable within the outer sleeve;

an annular seating collar located within the through bore of the inner sleeve;

a plurality of ports in the side wall of the inner sleeve, wherein each port is axially spaced along the inner sleeve;

pressure sensitive stop means for retaining the inner sleeve in place within the outer sleeve at predetermined axially spaced positions; and means for obstructing the annular seating collar and each port in the inner sleeve in a predetermined sequence such that when cleaning fluid is first connected to the cleaning device, the cleaning fluid passes through the inner sleeve and with the insertion of the first and each subsequent obstructing means, the inner sleeve is caused to move axially downwards relative to the outer sleeve onto each pressure sensitive stop means in turn, and in each of these positions one port in the inner sleeve is radially aligned with one port in the outer sleeve.

2. A cleaning device according to claim 1, further comprising circumferentially spaced ports in the side wall of the outer sleeve.

3. A cleaning device according to claim 2, wherein the ports in the inner sleeve correspond in number, axial spacing and circumferential spacing with the ports in the outer sleeve.

4. A cleaning device according to claim 2, wherein the pressure sensitive stop means comprises at least one axially extending slot in the outer surface of the inner sleeve and a plurality of shear pins axially spaced apart along the slot, and the shear pins are inserted into the slot through receiving holes in the outer sleeve.

5. A cleaning device according to claim 1, wherein said ports in the side wall of the inner sleeve are connected to jetting nozzles facing radially outwardly from the outer sleeve.

6. A cleaning device according to claim 5, wherein at least one of the jetting nozzles is followed axially along the outer sleeve by circumferentially spaced flushing ports.

7. A cleaning device according to claim 5, wherein each of the jetting nozzles comprises an elongated hollow tube one end of which extends through an aperture in the outer wall of the outer sleeve and the opposite end of which is connected to a piston having an aperture therein in alignment with the through bore in the tube, which piston is mounted in a cylinder formed in and opening into the inner wall of the outer sleeve and resilient biasing means for biasing the piston and hence the elongated hollow tube towards the end of the cylinder which opens into the inner wall of the outer sleeve.

8. A cleaning device according to claim 1, wherein said at least one port in the side wall of the outer sleeve defines a radially outwardly facing flushing port.

9. A cleaning device according to claim 8, wherein a jetting nozzle is followed axially along the outer sleeve by circumferentially spaced flushing ports.

10. A cleaning device according to claim 1, wherein the obstructing means has a diameter substantially equal to the diameter of the through bore in the inner sleeve.

11. A cleaning device according to claim 10, wherein the obstructing means are ball bearings.

12. A cleaning device according to claim 10, wherein the obstructing means are elongated cylindrical bars.

13. A cleaning device according to claim 10, wherein the obstructing means is at least one ball bearing and at least one elongated cylindrical bar.

14. A cleaning device according to claim 10, wherein the diameter of the through bore in the inner sleeve is constant from one end to the other.

15. A cleaning device according to claim 10, wherein the obstructing means comprise ball bearings of progressively increasing diameter and the diameter of the through bore in the inner sleeve increases in steps to define a plurality of seating collars each of which accommodates a respective one of the said ball bearings.

16. A cleaning device according to claim 1, wherein each of the obstructing means comprises sealing means for forming a fluid tight seal with the inner wall of the drill string down which each of the obstructing means is dropped.

17. A cleaning device according to claim 16, wherein sealing means is made of a flexible material and takes the form of at least one saucer shaped disc connected one behind the other to the rear end of the obstructing means by a short shaft.

18. A cleaning device according to claim 17, wherein the flexible material is rubber.

19. A cleaning device according to claim 1, wherein the obstructing means comprises an elongated tubular member the outer diameter of which is substantially the same as the inner diameter of the through bore of the inner sleeve and one end of which is closed, having at least one axially spaced through apertures in the side thereof which, when the elongated tubular member is dropped into the inner sleeve, open onto at least one of the axially spaced ports in the side thereof.

20. A cleaning device according to claim 19, wherein the obstructing means further comprises balls, each of which have a diameter substantially equal to the inner diameter of the elongated tubular member and are adapted to be received therein to obstruct and close of the said axially spaced through apertures in the side thereof.

21. A cleaning device according to claim 20, wherein the balls are of the same diameter.

22. A cleaning device according to claim 20, wherein the balls are of progressively increasing diameter and the internal diameter of the tubular elongated member increases from bottom to top in steps to define a plurality of seating collars each of which accommodates a respective one of the balls.

23. A cleaning device according to claim 19, wherein the obstructing means further comprises elongated cylindrical bars, each of which have a diameter substantially equal to the inner diameter of the elongated tubular member and are adapted to be received therein to obstruct and close off the said axially spaced through apertures in the side thereof.

24. A cleaning device according to claim 23, wherein the elongated cylindrical bars are of the same diameter.

25. A cleaning device according to claim 24, wherein the cylindrical elongated bars are of progressively increasing diameter and the internal diameter of the tubular elongated member increases from bottom to top in steps to define a plurality of seating collars each of which accommodates a respective one of the cylindrical elongated bars.

26. A cleaning device according to claim 19, wherein the obstructing means further comprises at least one ball and at least one elongated cylindrical bar, each of which have a diameter substantially equal to the inner diameter of the elongated tubular member and are adapted to be received therein to obstruct and close off the said axially spaced through apertures in the side thereof.

27. A cleaning device according to claim 26, wherein each ball and each elongated cylindrical bar has the same diameter.

28. A cleaning device according to claim 19, wherein each ball and each elongated cylindrical bar is of progressively increasing diameter and the internal diameter of the tubular elongated member increases from bottom to top in steps to define a plurality of seating collars each of which accommodates a respective one of the balls and bars.

29. A cleaning device according to claim 1, wherein the said pressure sensitive stop means comprise shear pins located at axially spaced intervals in the inner wall of the outer sleeve.

30. A cleaning device according to claim 29, wherein the inner sleeve comprises a detachable ring at the lowermost end thereof which serves to shear the said shear pins.

31. A cleaning device according to claim 29, wherein a plurality of circumferential grooves are provided in the inner surface of the through bore in the outer sleeve and a radially flexible tongue is carried by the inner sleeve which is adapted to engage in each of said circumferential grooves in turn as the inner sleeve moves downward relative to the outer sleeve thereby ensuring correct alignment of the inner and outer sleeves from one position to the next.

32. A cleaning device according to claim 31, wherein the said radially flexible tongue is comprised of spring steel.

33. A cleaning device according to claim 31, wherein the said radially flexible tongue is detachably connected to the inner sleeve.

34. A cleaning device according to claim 1, wherein the cleaning device further comprises an hydraulic braking system to absorb the energy of the inner sleeve as it moves downward relative to the outer sleeve from one position to the next.

35. A cleaning device according to claim 34, wherein the hydraulic brake comprises a spring and a series of collapsible compartments, each of which is connected to the other through a bleed hole, positioned inside an outer compartment, immediately beneath the inner sleeve.

36. A cleaning device according to claim 1, wherein additional ports are also provided in the inner sleeve immediately above and below the seating collar, and an axially extending slot is provided in the inner wall of the outer sleeve and the length of the axial position of which corresponds with that of the said ports in the inner sleeve, such that when the inner sleeve moves downwards relative to the outer sleeve the two ports are connected via the said slot thereby enabling cleaning fluid to be pumped through the cleaning device past the seating collar when the seating collar is obstructed.

37. A cleaning device according to claim 1, wherein the cleaning device is connected to a drill string for insertion into a well bore.

38. A cleaning device for a well bore which is adapted to be connected to a drill string for insertion into the well bore and through which cleaning fluid is pumped, comprising:

an elongated outer sleeve having an axially extending through bore therein;

means for connecting one end of the outer sleeve to the drill string;

at least one port in the side wall of the outer sleeve, wherein each port is axially spaced alone the outer sleeve;

an elongated inner sleeve having an axially extending through bore therein and which is co-axial with and axially slidable within the outer sleeve;

an annular seating collar located within the through bore of the inner sleeve;

at least one port in the side wall of the inner sleeve, wherein each port is axially spaced along the inner sleeve;

pressure sensitive stop means for retaining the inner sleeve in place within the outer sleeve at predetermined axially spaced positions; and means for obstructing is the annular seating collar and each port in the inner sleeve in a predetermined sequence such that when cleaning fluid is first connected to the cleaning device, it the cleaning fluid passes through the inner sleeve and with the insertion of the first and each subsequent obstructing means, the inner sleeve is caused to move axially downwards relative to the inner sleeve onto each pressure sensitive stop means in turn, and in each of these positions one port in the inner sleeve is radially aligned with one port in the outer sleeve;

wherein said at least one port in the side wall of the inner sleeve is connected to a jetting nozzle facing radially outwardly from the outer sleeve, and the jetting nozzle is followed axially along the outer sleeve by circumferentially space flushing ports.

39. A cleaning device according to claim 38, wherein the obstructing means has a diameter substantially equal to the diameter of the through bore in the inner sleeve.

40. A cleaning device according to claim 39, wherein the obstructing means are ball bearings.

41. A cleaning device according to claim 39, wherein the obstructing means are elongated cylindrical bars.

42. A cleaning device according to claim 39, wherein the obstructing means is at least one ball bearing and at least one elongated cylindrical bar.

43. A cleaning device according to claim 39, wherein the diameter of the through bore in the inner sleeve is constant from one end to the other.

44. A cleaning device according to claim 39, wherein the obstructing means comprise ball bearings of progressively increasing diameter and the diameter of the through bore in the inner sleeve increases in steps to define a plurality of seating collars each of which accommodates a respective one of the said ball bearings.

45. A cleaning device according to claim 38, wherein the said pressure sensitive stop means comprise shear pins located at axially spaced intervals in the inner wall of the outer sleeve.

46. A cleaning device according to claim 45, wherein the inner sleeve comprises a detachable ring at the lowermost end thereof which serves to shear the said shear pins.

47. A cleaning device according to claim 45, wherein a plurality of circumferential grooves are provided in the inner surface of the through bore in the outer sleeve, corresponding in number and axially spacing to the shear pins and a radially flexible tongue is carried by the inner sleeve which is adapted to engage in each of said circumferential grooves in turn as the inner sleeve moves downward relative to the outer sleeve thereby ensuring correct alignment of the inner and outer sleeves from one position to the next.

48. A cleaning device according to claim 47, wherein the said radially flexible tongue is comprised of spring steel.

49. A cleaning device according to claim 47, wherein the said radially flexible tongue is detachably connected to the inner sleeve.

50. A cleaning device according to claim 38, wherein the jetting nozzle comprises an elongated hollow tube one end of which extends through an aperture in the outer wall of the outer sleeve and the opposite end of which is connected to a piston having an aperture therein in alignment with the through bore in the tube, which piston is mounted in a cylinder formed in and opening into the inner wall of the outer sleeve and resilient biasing means for biasing the piston and hence the elongated hollow tube towards the end of the cylinder which opens into the inner wall of the outer sleeve.

51. A cleaning device according to claim 38, wherein additional ports are also provided in the inner sleeve immediately above and below the seating collar, and an axially extending slot is provided in the inner wall of the outer sleeve and the length of the axial position of which corresponds with that of the said ports in the inner sleeve, such that when the inner sleeve moves downwards relative to the outer sleeve the two ports are connected via the said slot thereby enabling cleaning fluid to be pumped through the cleaning device past the seating collar when the seating collar is obstructed.

52. A cleaning device according to claim 38, wherein the cleaning device is connected to a drill string for insertion into a well bore.

53. A cleaning device for a well bore which is adapted to be connected to a drill string for insertion into the well bore and through which cleaning fluid is pumped, comprising:

an elongated outer sleeve having an axially extending through bore therein;

means for connecting one end of the outer sleeve to the drill string;

at least one port in the side wall of the outer sleeve, wherein each port is axially spaced along the outer sleeve;

an elongated inner sleeve having an axially extending through bore there in and which is co-axial with and axially slidable within the outer sleeve;

an annular seating collar located within the through bore of the inner sleeve;

at least one port in the side wall of the inner sleeve, wherein each port is axially spaced along the inner sleeve;

pressure sensitive stop means for retaining the inner sleeve in place within the outer sleeve at predetermined axially spaced positions; and means for obstructing the annular seating collar and each port in the inner sleeve in a predetermined sequence such that when cleaning fluid is first connected to the cleaning device, the cleaning fluid passes through the inner sleeve and with the insertion of the first and each subsequent obstructing means, the inner sleeve is caused to move axially downwards relative to the outer sleeve onto each pressure sensitive stop means in turn, and in each of these positions one port in the inner sleeve is radially aligned with one port in the outer sleeve;

wherein each of the obstructing means comprises sealing means for forming a fluid tight seal with the inner wall of the drill string down which each of the obstructing means is dropped.

54. A cleaning device according to claim 53, wherein sealing means is made of a flexible material and takes the form of at least one saucer shaped disc connected one behind the other to the rear end of the obstructing means by a short shaft.

55. A cleaning device according to claim 54, wherein the flexible material is rubber.

56. A cleaning device for a well bore which is adapted to be connected to a drill string for insertion into the well bore and through which cleaning fluid is pumped, comprising:

an elongated outer sleeve having an axially extending through bore therein;

means for connecting one end of the outer sleeve to the drill string;

at least one port in the side wall of the outer sleeve, wherein each port is axially spaced along the outer sleeve;

an elongated inner sleeve having an axially extending through bore therein and which is co-axial with and axially slidable within the outer sleeve;

an annular seating collar located within the through bore of the inner sleeve;

at least one port in the side wall of the inner sleeve, wherein each port is axially spaced along the inner sleeve;

pressure sensitive stop means for retaining the inner sleeve in place within the outer sleeve at predetermined axially spaced positions; and means for obstructing the annular seating collar and each port in the inner sleeve in a predetermined sequence such that when cleaning fluid is first connected to the cleaning device, the cleaning fluid passes through the inner sleeve and with the insertion of the first and each subsequent obstructing means, the inner sleeve is caused to move axially downwards relative to the outer sleeve onto each pressure sensitive stop means in turn, and in each of these positions one port in the inner sleeve is radially aligned with one port in the outer sleeve;

wherein the obstructing means comprises an elongated tubular member the outer diameter of which is substantially the same as the inner diameter of the through bore of the inner sleeve, and one end of which is closed, having at least one axially spaced through apertures in the side thereof which, when the elongated tubular member is dropped into the inner sleeve, open onto at least one of the axially spaced ports in the side thereof.

57. A cleaning device according to claim 56, wherein the obstructing means further comprises balls, each of which have a diameter substantially equal to the inner diameter of the elongated tubular member and are adapted to be received therein to obstruct and close off the said axially spaced through apertures in the side thereof.

58. A cleaning device according to claim 56, wherein the balls are of the same diameter.

59. A cleaning device according to claim 57, wherein the balls are of progressively increasing diameter and the internal diameter of the tubular elongated member increases from bottom to top in steps to define a plurality of seating collars each of which accommodates a respective one of the balls.

60. A cleaning device according to claim 56, wherein the obstructing means further comprises elongated cylindrical bars, each of which have a diameter substantially equal to the inner diameter of the elongated tubular member and are adapted to be received therein to obstruct and close off the said axially spaced through apertures in the side thereof.

61. A cleaning device according to claim 60, wherein the elongated cylindrical bars are of the same diameter.

62. A cleaning device according to claim 61, wherein the cylindrical elongated bars are of progressively increasing diameter and the internal diameter of the tubular elongated member increases from bottom to top in steps to define a plurality of seating collars each of which accommodates a respective one of the cylindrical elongated bars.

63. A cleaning device according to claim 56, wherein the obstructing means further comprises at least one ball and at least one elongated cylindrical bar, each of which have a diameter substantially equal to the inner diameter of the elongated tubular member and are adapted to be received therein to obstruct and close off the said axially spaced through apertures in the side thereof.

64. A cleaning device according to claim 63, wherein each ball and each elongated cylindrical bar has the same diameter.

65. A cleaning device according to claim 63, wherein each ball and each elongated cylindrical bar is of progressively increasing diameter and the internal diameter of the tubular elongated member increases from bottom to top in steps to define a plurality of seating collars each of which accommodates a respective one of the balls and the bars.

66. A cleaning device for a well bore which is adapted to be connected to a drill string for insertion into the well bore and through which cleaning fluid is pumped, comprising:

an elongated outer sleeve having an axially extending through bore therein;

means for connecting one end of the outer sleeve to the drill string;

at least one port in the side wall of the outer sleeve, wherein each port is axially spaced along the outer sleeve;

an elongated inner sleeve having an axially extending through bore therein and which is co-axial with and axially slidable within the outer sleeve;

an annular seating collar located within the through bore of the inner sleeve;

at least one port in the side wall of the inner sleeve, wherein each port is axially spaced along the inner sleeve;

pressure sensitive stop means for retaining the inner sleeve in place within the outer sleeve at predetermined axially spaced positions;

means for obstructing the annular seating collar and each port in the inner sleeve in a predetermined sequence such that when cleaning fluid is first connected to the cleaning device, the cleaning fluid passes through the inner sleeve and with the insertion of the first and each subsequent obstructing means, the inner sleeve is caused to move axially downwards relative to the outer sleeve onto each pressure sensitive stop means in turn, and in each of these positions one port in the inner sleeve is radially aligned with one port in the outer sleeve; and an hydraulic braking system to absorb the energy of the inner sleeve as it moves downward relative to the outer sleeve from one position to the next.

67. A cleaning device according to claim 66, wherein the hydraulic brake comprises a spring and a series of collapsible compartments, each of which is connected to the other through a bleed hole, positioned inside the outer compartment, immediately beneath the inner sleeve.

* * * * *